US007458555B2

(12) United States Patent
Mastropaolo et al.

(10) Patent No.: US 7,458,555 B2
(45) Date of Patent: Dec. 2, 2008

(54) MULTI-POSITIONAL UNIVERSAL BOOK HOLDER

(75) Inventors: Cosmo D. Mastropaolo, Morristown, NJ (US); Mary Ann Mastropaolo, Morristown, NJ (US); Joseph R. Petrella, Jr., Flemington, NJ (US)

(73) Assignee: Together Us Two LLC, Morristown, NJ (US)

( * ) Notice: Subject to any disclaimer, the term of this patent is extended or adjusted under 35 U.S.C. 154(b) by 534 days.

(21) Appl. No.: 11/200,701

(22) Filed: Aug. 10, 2005

(65) Prior Publication Data

US 2007/0034767 A1 Feb. 15, 2007

(51) Int. Cl.
*A47B 5/04* (2006.01)

(52) U.S. Cl. ..... 248/447.2; 248/444.1; 248/452; 248/231.71; 248/160; 248/311.2

(58) Field of Classification Search ..... 248/160, 248/441.1, 444.1, 447.2, 458, 231.71, 311.2, 248/181.1, 288.51, 288.31, 452
See application file for complete search history.

(56) References Cited

U.S. PATENT DOCUMENTS

| | | | | |
|---|---|---|---|---|
| 96,702 | A | 11/1869 | Johnson | |
| 103,593 | A | 5/1870 | Flint | |
| 160,044 | A | 2/1875 | Wilson | |
| 319,105 | A | 6/1885 | McClure | |
| 376,593 | A | 1/1888 | Greenawalt et al. | |
| 431,036 | A * | 7/1890 | Dawson | 248/454 |
| 485,471 | A | 11/1892 | Morrison | |
| 632,037 | A | 8/1899 | Bauer | |
| 758,924 | A | 5/1904 | Law | |
| 804,462 | A | 11/1905 | Fowble | |
| 819,910 | A | 5/1906 | Myers | |
| 936,936 | A | 10/1909 | Phelps | |
| 1,216,321 | A | 2/1917 | Inami | |
| 1,281,682 | A | 10/1918 | Southworth | |
| 1,336,275 | A | 4/1920 | Boyer | |
| 1,372,431 | A * | 3/1921 | Husi | 248/231.71 |
| 1,682,180 | A | 8/1928 | Merrill | |
| 1,821,060 | A | 9/1931 | Isaacson | |

(Continued)

OTHER PUBLICATIONS

Solutions Products Work . . . Guaranteed, Solutions 46; www.SolutionsCatalog.com;1 page.

(Continued)

*Primary Examiner*—Gwendolyn Baxter
(74) *Attorney, Agent, or Firm*—Watov & Kipnes, P.C.; Kenneth Watov

(57) ABSTRACT

A book holder includes a tray for holding a book, a ball joint and swivel assembly connected between the back of the tray and one end of a gooseneck, and a C-clamp connected to the other end of gooseneck, whereby the book holder can be attached to an arm of indoor and outdoor furniture with the tray being rotatable in the plane of its front face over 360° to a desired position, rotatable about the longitudinal axis of the gooseneck to a desired position, and the gooseneck bent to further position the tray, thereby permitting a user to be sitting or prone with a book positioned on the tray in a desired reading position, or permitting the book holder to be moved while still attached to the furniture, to a non-use position out of the way of a user.

17 Claims, 16 Drawing Sheets

U.S. PATENT DOCUMENTS

| | | | | |
|---|---|---|---|---|
| 2,638,701 | A | 5/1953 | Dahlgren | |
| 4,568,052 | A | 2/1986 | Solomon et al. | 248/281.1 |
| 4,569,498 | A * | 2/1986 | Ermanski | 248/441.1 |
| 4,620,687 | A * | 11/1986 | Bishop | 248/447.2 |
| 4,681,291 | A * | 7/1987 | Holladay | 248/444.1 |
| 4,795,211 | A * | 1/1989 | Stern et al. | 297/188.18 |
| 5,308,034 | A * | 5/1994 | Hunter | 248/452 |
| 5,709,365 | A | 1/1998 | Howard | 248/454 |
| 5,884,888 | A | 3/1999 | Grimes, III et al. | 248/441.1 |
| 5,996,957 | A * | 12/1999 | Kurtz | 248/311.2 |
| 6,206,464 | B1 | 3/2001 | Santa Rosa et al. | 297/173 |
| 6,561,476 | B2 * | 5/2003 | Carnevali | 248/288.31 |
| 6,820,849 | B2 * | 11/2004 | Kennard | 248/231.61 |
| 6,929,229 | B1 * | 8/2005 | Palmby | 248/311.2 |
| 2001/0032915 | A1 * | 10/2001 | Clifford | 248/311.2 |
| 2005/0092877 | A1 * | 5/2005 | Carnevali | 248/160 |

OTHER PUBLICATIONS

The Reader's Window®; Reader's Window® *over-head* book holder; http://www.readerswindow.com/; May 13, 2004; 1 page.

BeachStore.com—Detail; BeachStore.com everything under the sun; http://www.beachstore.com/detail.aspx?ID=952; May 13, 2004; 1 page.

* cited by examiner

MULTI-POSITIONAL UNIVERSAL BOOK HOLDER

FIELD OF THE INVENTION

The present invention relates generally to book holders, and more particularly to book holders for attachment to the arms of furniture.

BACKGROUND OF THE INVENTION

Book holders are well known in the art. Many prior book holders are freestanding, whereas others are designed for attachment to various types of furniture, including chairs, beds, and so forth.

SUMMARY OF THE INVENTION

An object of the invention is to provide an improved book holder.

Another object of the invention is to provide a book holder with a book tray that can be placed into substantially any desired orientation useful to a user, whether the user is sitting or lying prone on a piece of indoor or outdoor furniture.

With these and other objects in mind, one embodiment of present invention is a book holder that includes a book tray on a back face connected via positional means to one end of a gooseneck, whereby the positional means permits the book tray to be rotated about the plane of its front face to a desired position between zero and 360°, and to be rotated in an arc in multiple planes perpendicular to the longitudinal axis of the gooseneck, and also with the gooseneck being bendable to position the book tray into a desired position, with the other end of the gooseneck being connected to means for clamping it to the arm of a piece of indoor/outdoor furniture. In other embodiments of the invention, a cup holder is rotationally attached to the clamping means, and a cap holder is rigidly attached to the cup holder. In yet another embodiment of the invention, the cup holder includes means for holding cups of different diameters or sizes.

BRIEF DESCRIPTION OF THE DRAWINGS

Various embodiments of the present invention are described in association with the drawings, in which like items are identified by the same reference designation, wherein.

DETAILED DESCRIPTION OF THE INVENTION

Figure 1:
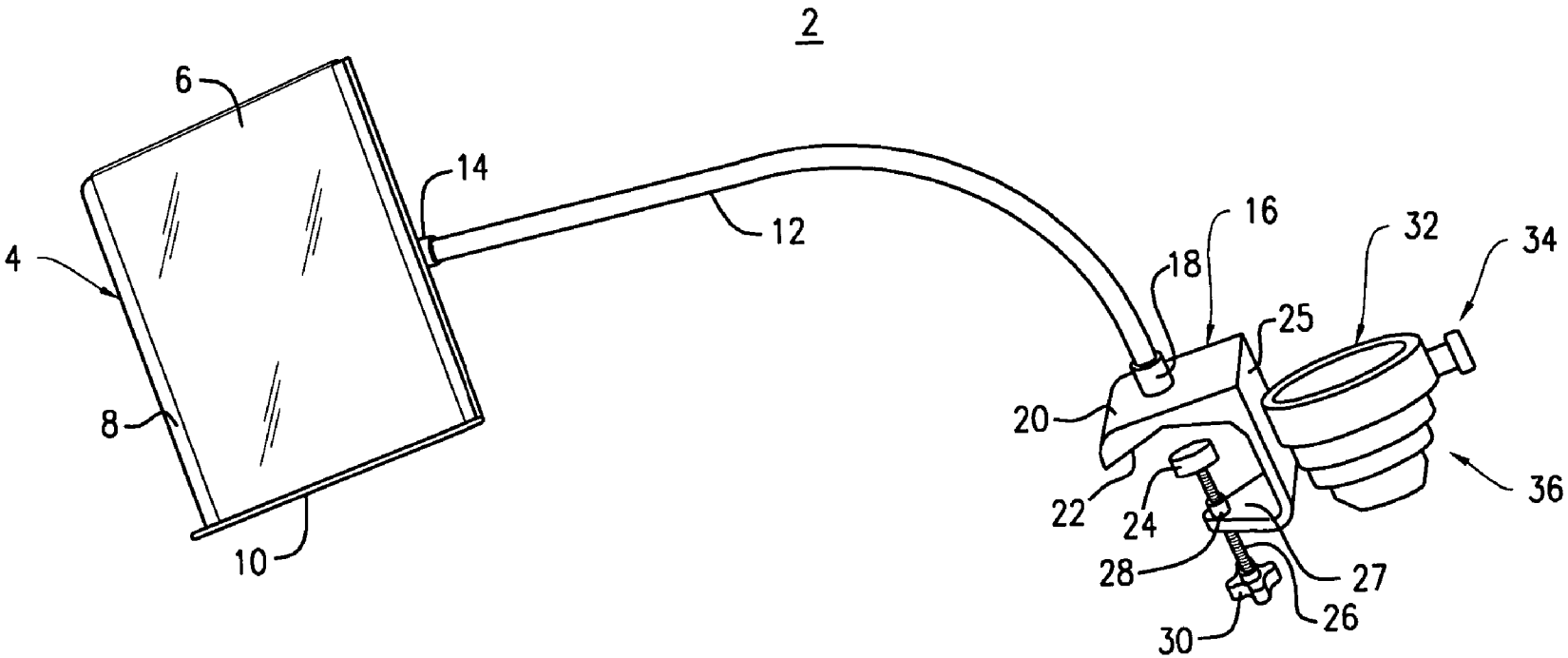
FIG. 1 is a pictorial diagram looking at the front of a book tray, the side portions of a gooseneck attached to the tray, and to a C-Clamp, the latter having a cup holder attached thereto, for one embodiment of the invention.

The various embodiments of the present invention will now be described in detail with reference to the associated drawings. With reference to FIG. 1, in one embodiment of the present invention a universal book holder 2 includes a book holder tray 4 that has a front face or backrest 8, and a lowermost extended lip 10 for retaining a book thereon. An anti-glare film 6 is secured to a top portion of the book holder tray 4 for permitting a user to more easily read a book in the presence of bright sunlight, such as encountered on a beach or other places outdoors. A portion of a swivel head 14 is shown attached to one end of a super flexible gooseneck arm 12, whereby the swivel head 14 is part of a combined ball joint and swivel head assembly attached to the back of the book holder tray 4, as will be described in detail below. The other end of the gooseneck arm 12 is rigidly attached via a retention collar 18 to a vise assembly 16, as shown.

The vise assembly 16 includes a C-clamp jaw 20 that has an angled interior top clamp face 22, as shown, for securement to round or flat arms of furniture. The bottom 27 of the C-clamp jaw, in this embodiment, is triangularly shaped, as shown. A threaded standoff 28 is secured to the outermost portion of the bottom 27 with a throughhole therein (not shown) for receiving the threaded bolt shaft 26 that has one end connected to a moveable circular jaw 24 that is spaced from and opposes the bottom of the angled interior top clamp face 22, as shown. The other end of the threaded bolt shaft 26 is rigidly connected to the vise-clamp knob 30.

A cup holder 32 is rotatably mounted to the back 25 of the C-clamp jaw 20, and a hat or cap hanger 34 is rigidly attached to the cup holder 32, as shown. Note that the cup holder 32 includes a plurality of successively reduced diameter retention rings 36 for permitting the retention of different size cups.

Figure 2:
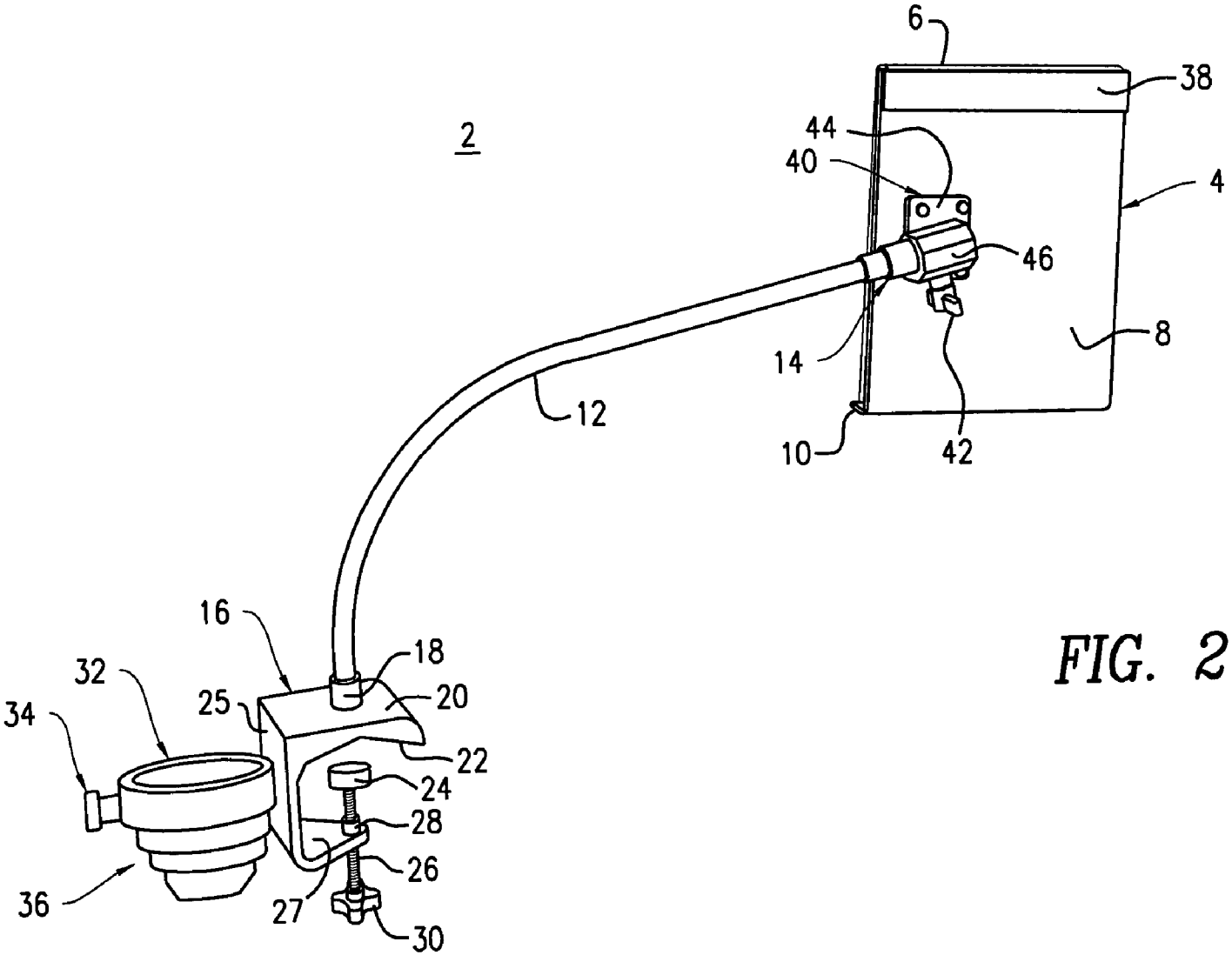
FIG. 2 is a pictorial diagram looking from the rear or back portion of the book tray relative to the pictorial view of FIG. 1.
Figure 4:
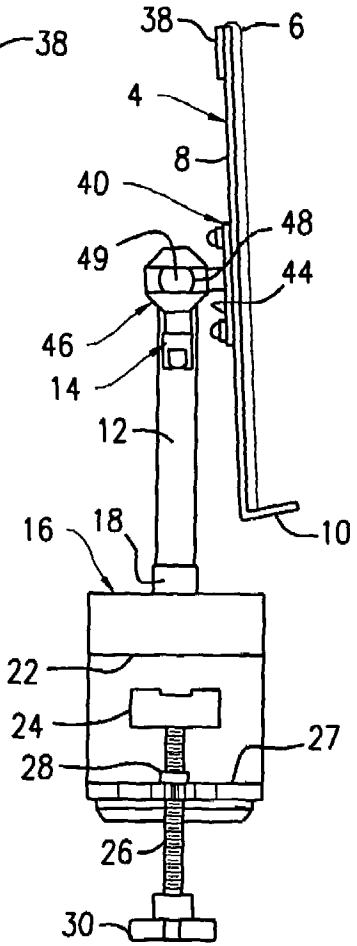
FIG. 4 is a right-side elevational view of the pictorial view of FIG. 3 for an embodiment of the invention.
Figure 3:
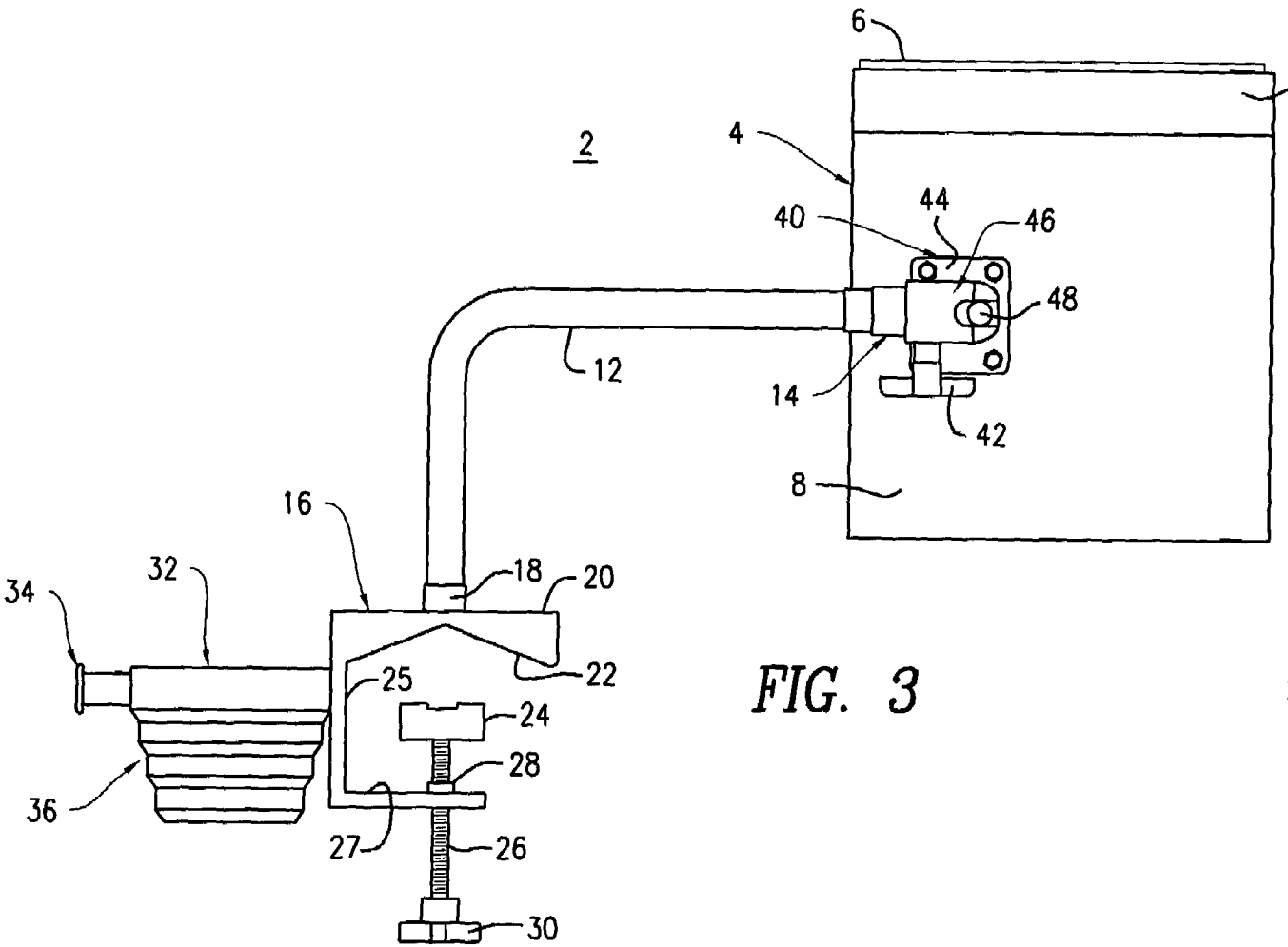
FIG. 3 is an enlarged pictorial diagram viewed from a slightly different angle relative to the pictorial view of FIG. 2.
Figure 5:
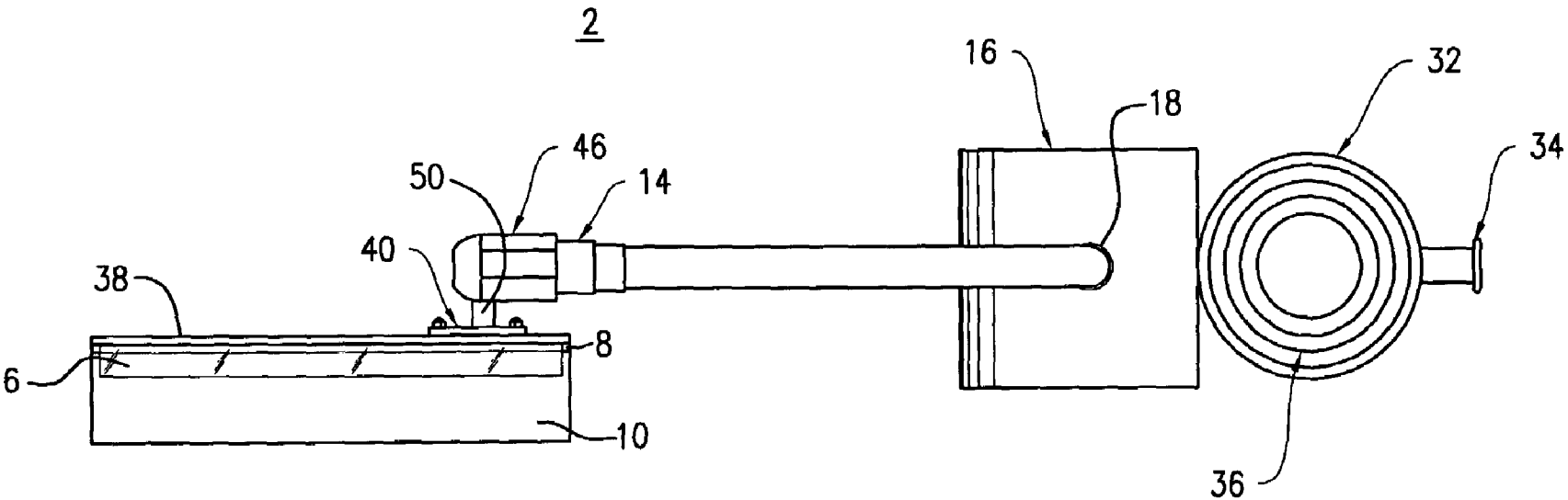
FIG. 5 is a top plan view relative to the pictorial view of FIG. 3 turned 180 degrees.
Figure 6:
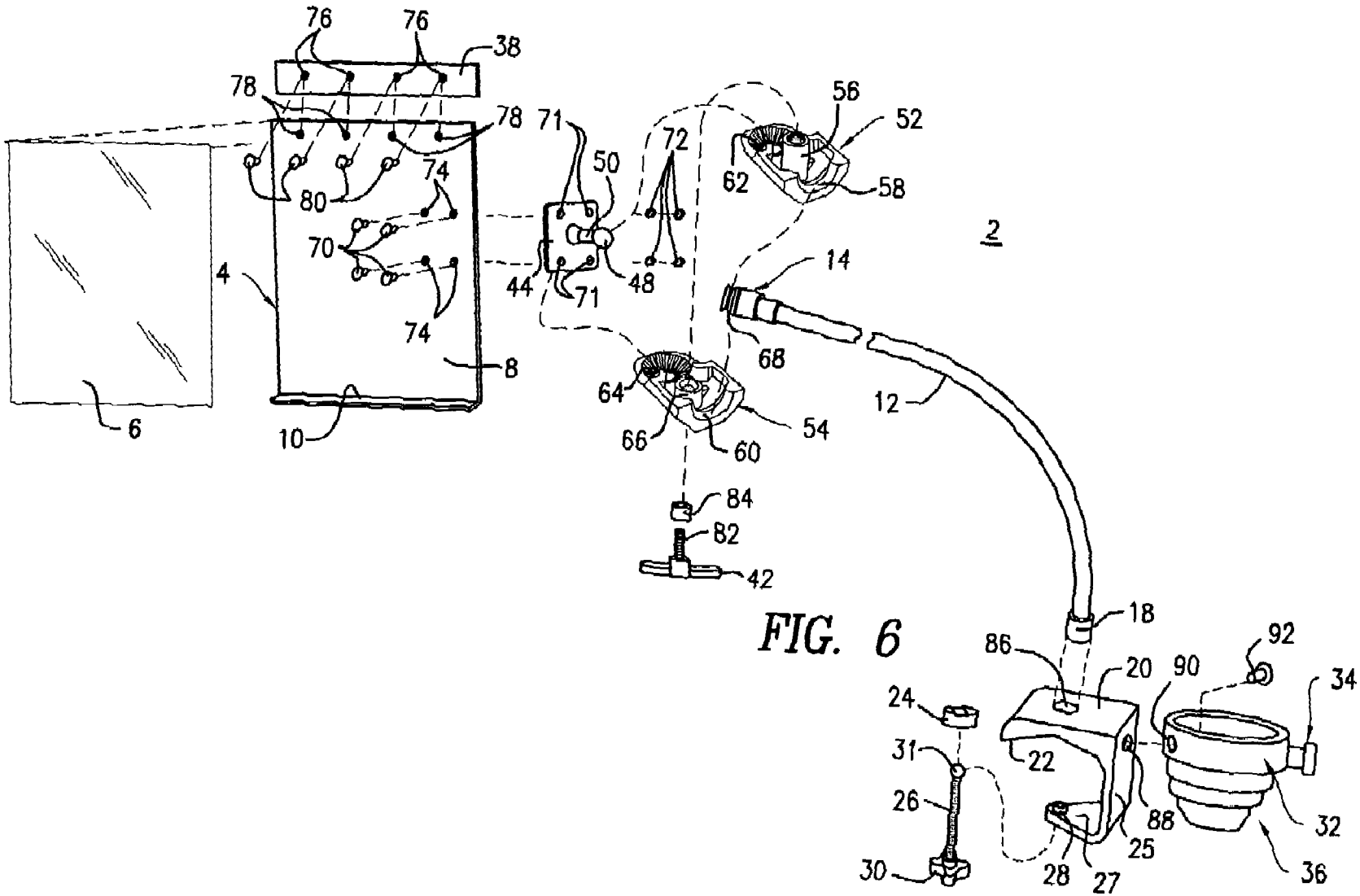
FIG. 6 is an exploded assembly view for the embodiment of the invention of FIGS. 1 through 5.

As shown in FIG. 2, a ball joint/swivel assembly 40 includes a housing 46 for captively retaining a portion of the swivel head 14, and a ball head 48 (see FIGS. 3 and 4). Adjustment knob 42 is connected to the housing 46, as will be described in detail below, for permitting tightening of the ball joint/swivel assembly 40 for fixing it in position, or for loosening of the same in order to adjust the positioning of the book holder tray 4.

As shown in FIGS. 2 through 6, the film retention strip 38 is secured to the top portion of the back of the book holder tray 4 for retaining therebetween an uppermost portion of the anti-glare film 6. With reference to the exploded assembly view of FIG. 6, the anti-glare film 6 is secured via sandwiching its uppermost top portion between film retention strip 38 and the back of the backrest 8 of book holder tray 4. In this example, threaded holes 76 through the film retention strip 38 receive screws 80 inserted through holes 78 in the top of the backrest 8, as shown. In this example, the ball joints/swivel assembly 40 has its mounting plate 44 secured to the back of the backrest 8 by use of screws 70 that are inserted through holes 74 from the front of backrest 8, through holes 71 of mounting plate 44, and screwed into nuts 72, as shown, for rigidly connecting the mounting plate 44 to the back of the backrest 8.

The ball shaft 50 has one end rigidly connected to the center of the mounting plate 44, and its other end rigidly connected to a ball head 48, as shown. The mounting plate 44, ball shaft 50, and ball head 48 can be provided by a single piece of material, such as an appropriate plastic or metal material, or can be assembled together as component parts, for example. The swivel head 14 is rigidly connected to one end of the gooseneck 12, as shown. The swivel head 14 includes a V-groove 68 at its end portions, as shown. The housing 46 (see FIG. 3) includes a first-half section 52 that is configured on its interior to include a female threaded bushing 56, in a ball retention semicircular cavity 62, as shown. The other half of the housing 46 is provided by an unthreaded section 54, the interior of which is configured to include an unthreaded bushing 66 that has a centrally located throughhole, and a semicircular cavity 64, as shown. Note that the semicircular cavities 62 and 64 are serrated, as shown. Housing section 52 also includes at one end a semicircular V-lip 58. Similarly, housing half section 54 includes at one end a semicircular V-lip 60, as shown. The threaded shaft 82 of the adjustment knob 42 is inserted through a spacer bushing 84, and therefrom through the unthreaded bushing 66 of housing section 54, and into the female threaded bushing 56 of the other housing half section 52. During this latter assembly, housing sections 52 and 54 are positioned for placing the cavities 62 and 64 thereof in opposition on either side of the ball head 48, and the V-lips 58 and 60 in opposition on either side of the V-groove 68 of swivel head 14, whereafter the adjustment knob 42 is turned in the appropriate direction for securing the housing halves 52 and 54 together while at the same time captively enclosing therein the ball head 48 and swivel head 14. As will be described further below, when the adjustment knob 42 is turned for tightening the housing half sections 52 and 54 against the ball head 48 and swivel head 14, the book holder tray 4 cannot be changed in position relative thereto. When the adjustment knob 42 is loose enough, the housing halves 52 and 54 can be rotated about the swivel head 14 over 360°, effectively allowing a user to rotate the face of the book holder tray 4 to a desired position over 360° in a plane that is coincident with the face or backrest 8 of the book holder tray 4, while at the same time permitting backrest 8 thereof to be rotated to a desired position by the movement of the ball head 48 within the semicircular cavities 62 and 64 of housing half sections 52 and 54, respectively.

As previously described, the other end of the gooseneck 12 is rigidly attached to the C-clamp jaw 20 via a retention collar 18 attached to the other end of the gooseneck 12. The collar 18 is rigidly secured within a hole 86 of the C-clamp jaw 20. The bolt shaft 26, as previously described, has one end rigidly secured to the vise clamp knob 30, and a mounting head 31 rigidly connected to the other end of the bolt shaft 26 is in turn captively secured to the circular jaw 24 which is slightly rotatable thereon, for accommodating the securement of a C-clamp jaw 20 to an arm of an indoor or outdoor furniture, as will be described further below. The cup holder 32 is rotationally secured to the back 25 of the C-clamp jaw 20 via a rivet 92 that has its shaft inserted through a hole 90 in the upper portion of the cup holder 32, and through a hole 88 in the back 25 of the C-clamp jaw 20, whereby the shaft of the rivet is peened over a sufficient amount for captively but rotatably mounting the cup holder 32 thereon, in this example. The cap or hat hanger 34 is rigidly connected to the outside wall of the other end of the upper portion of the cup holder 32, as shown in this example.

Figure 7:
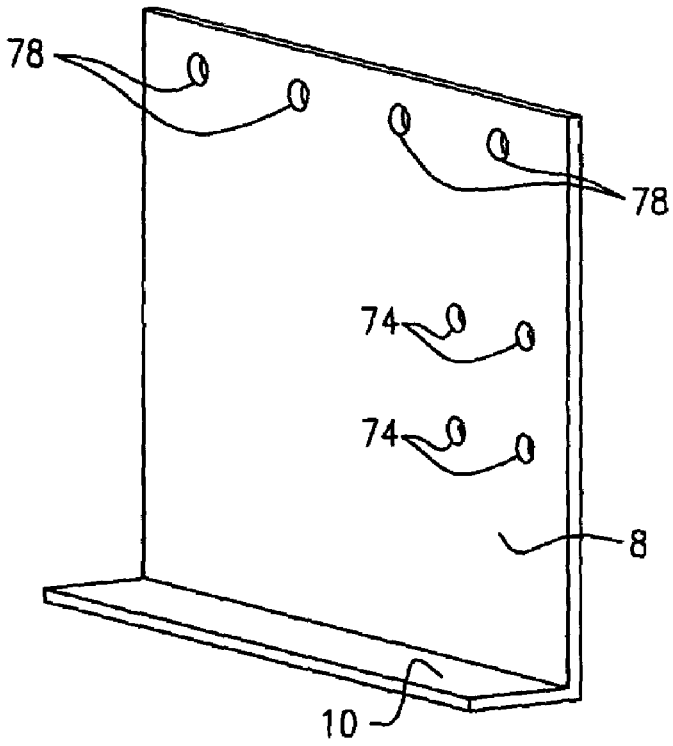
FIG. 7 is a pictorial view looking from the front of the book tray for one embodiment of the invention.
Figure 9:
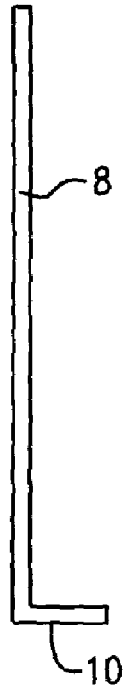
FIG. 9 is a left-side elevational view of the book tray of FIG. 7 for one embodiment of the invention.
Figure 8:
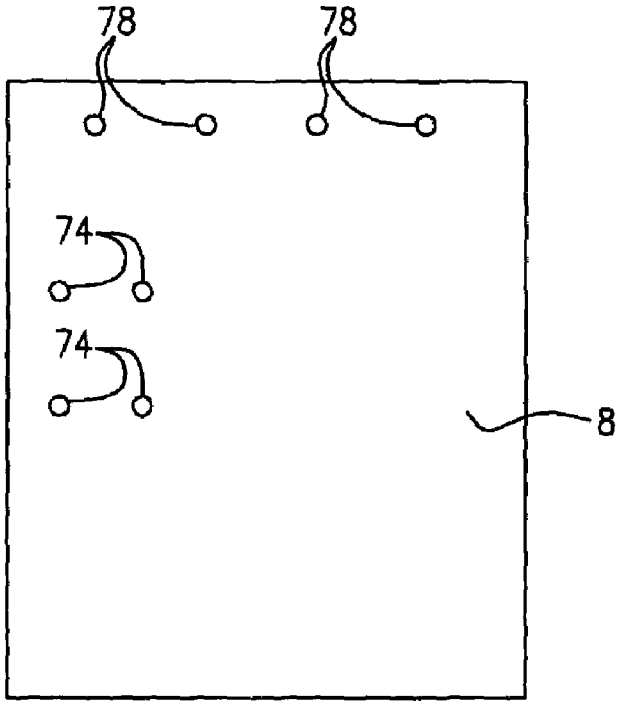
FIG. 8 is a back elevational view of the book tray of FIG. 7.
Figure 10A:
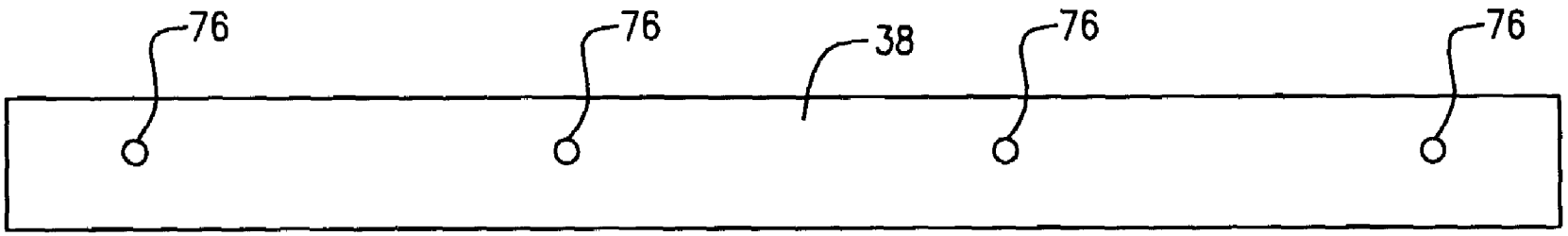
FIG. 10A is a front elevational view of a film retention strip for one embodiment of the invention.
Figure 10B:
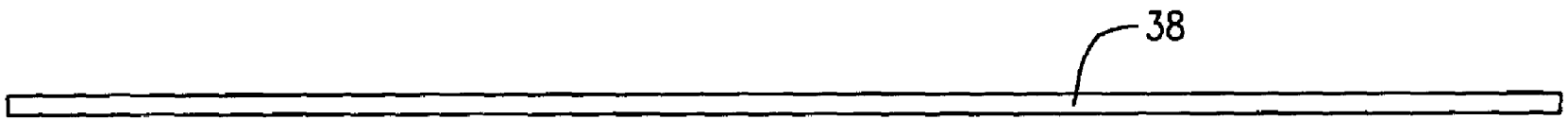
FIG. 10B is a top plan view of the film retention strip of FIG. 10A.
Figure 11:
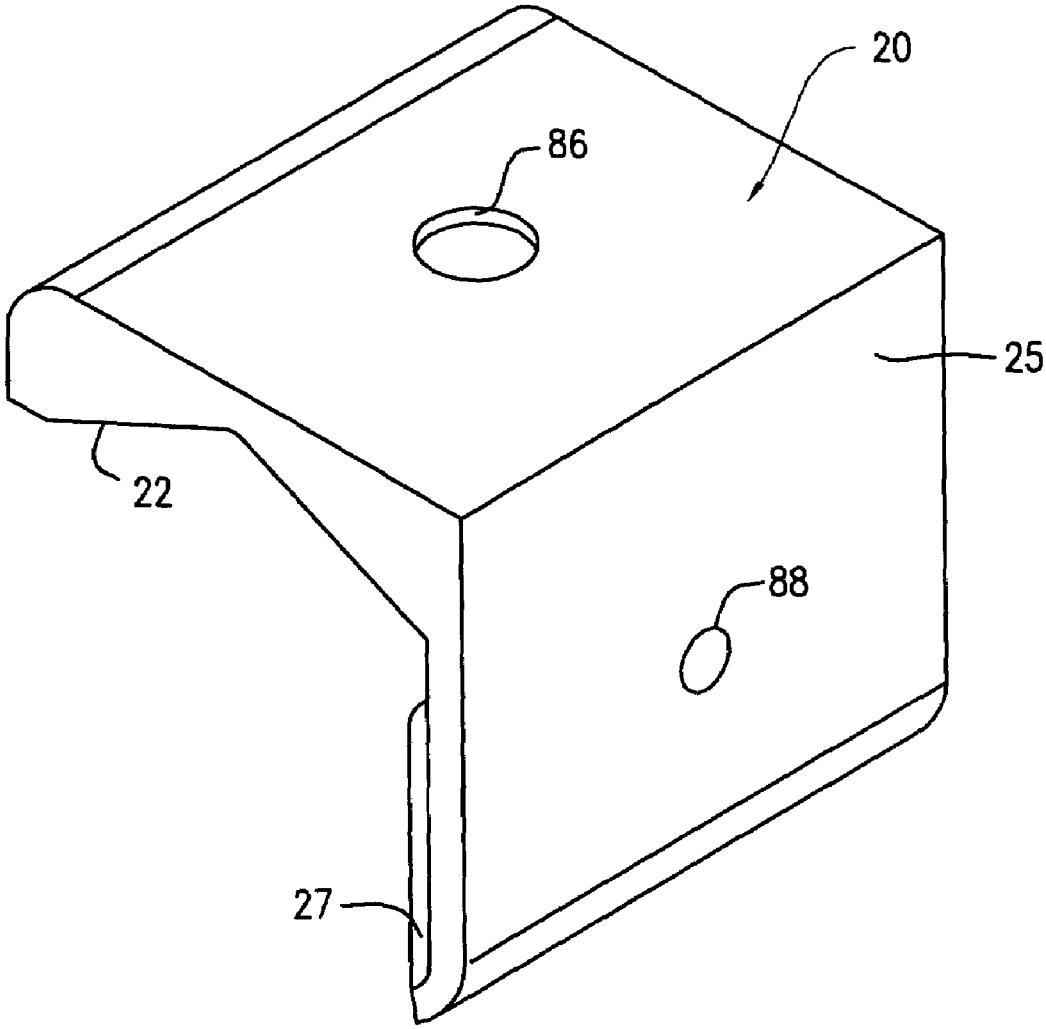
FIG. 11 is a pictorial view looking from a right side of a C-Clamp bracket or jaw for an embodiment of the invention.
Figure 12:
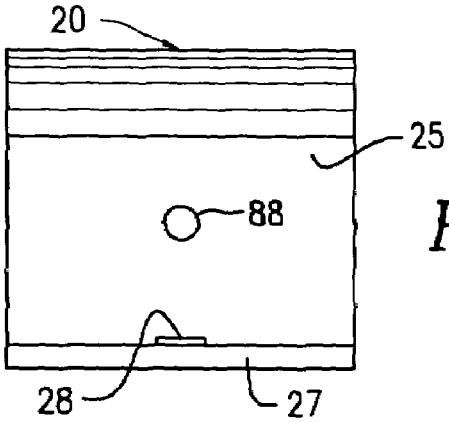
FIG. 12 is a front elevational view of the C-clamp jaw of FIG. 11.
Figure 13:
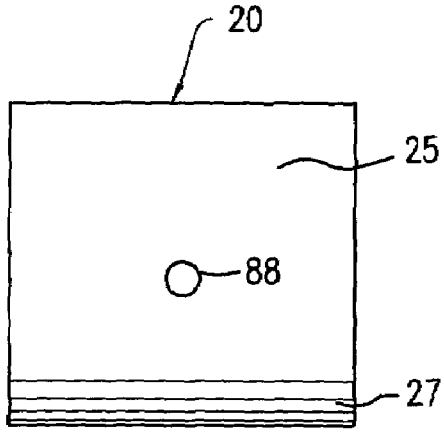
FIG. 13 is a back elevational view of the C-clamp jaw of FIG. 11.
Figure 14:
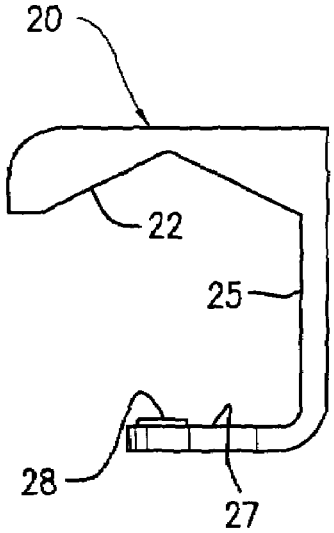
FIG. 14 is a right-side elevational view of the C-clamp jaw of FIG. 11.
Figure 15:
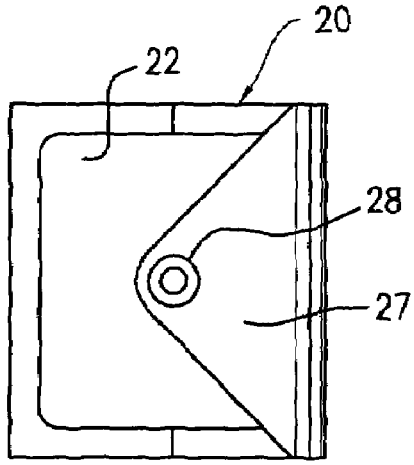
FIG. 15 is a bottom plan view of the C-clamp jaw of FIG. 11.
Figure 16:
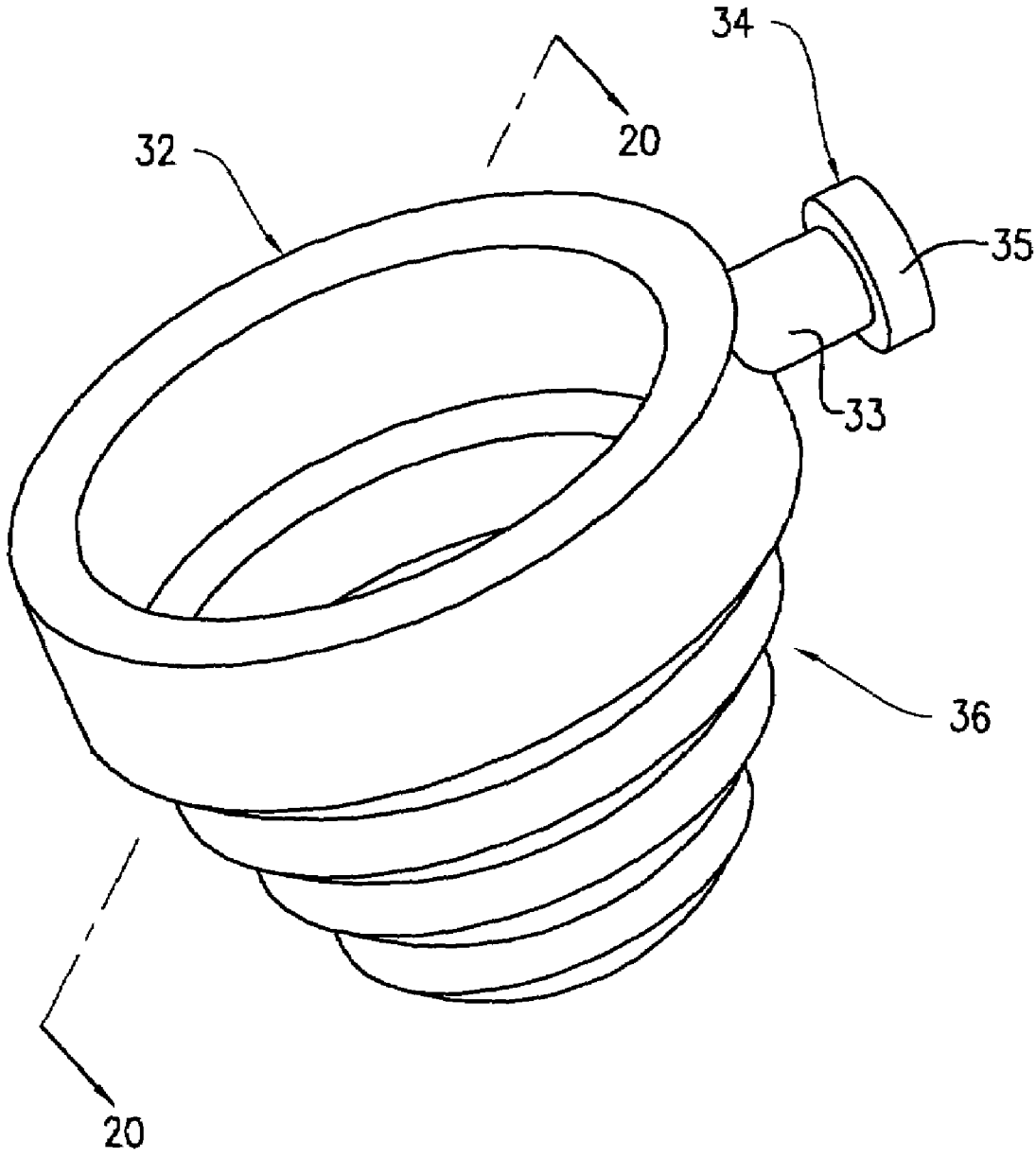
FIG. 16 is a pictorial view of a combined cup holder and cap holder for one embodiment of the invention.
Figure 17:
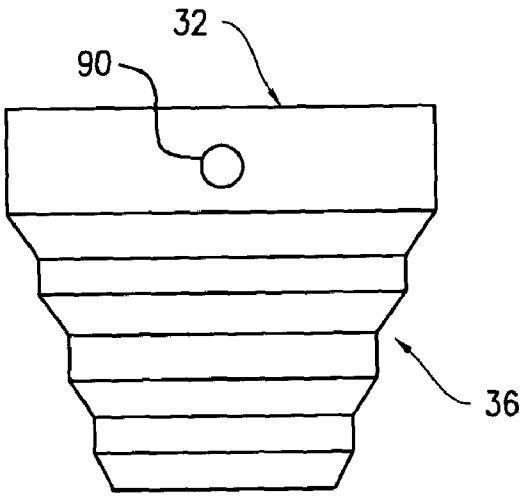
FIG. 17 is a front elevational view of the combined cup and cap holder of FIG. 16.
Figure 19:
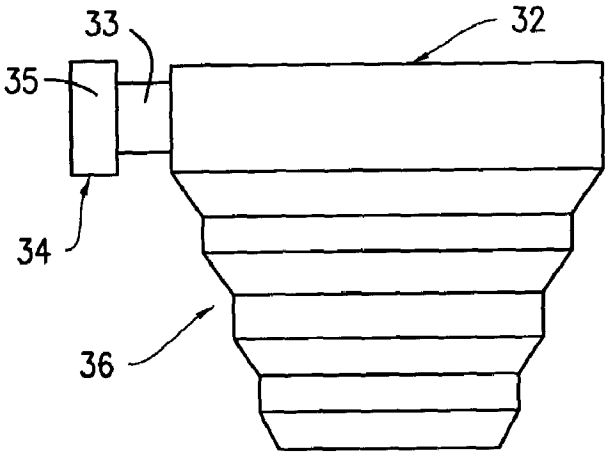
FIG. 19 is left-side elevational view of the combined cup and cap holder of FIG. 16.
Figure 18:
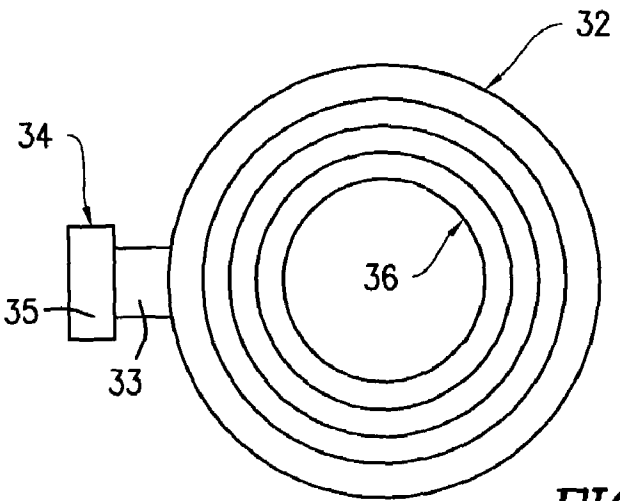
FIG. 18 is top plan view of the combined cup holder and cap holder of FIG. 16.
Figure 20:
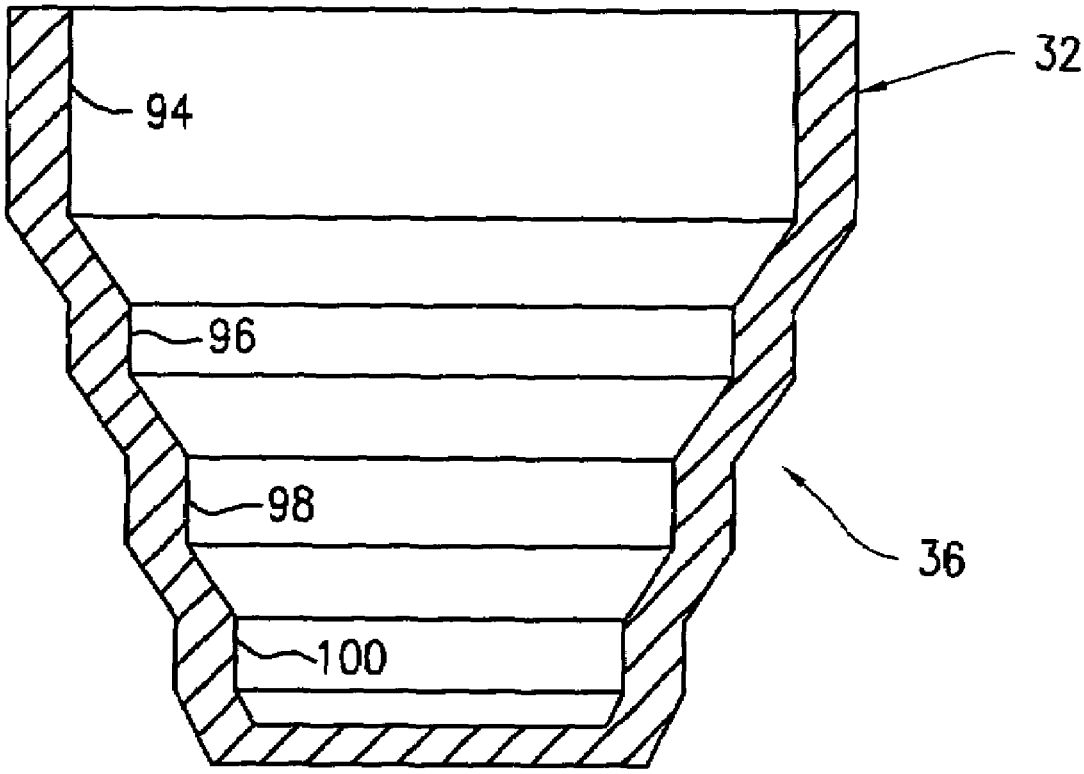
FIG. 20 is a cross-sectional view of taken along 20-20 of FIG. 16.

FIGS. 7 through 9 show enlarged views and details of the location of the holes 74, and 78 in the backrest 8, as previously described. Similarly, FIGS. 10A and 10B show enlarged views for the details of the locations of the holes 76 in the film retention strip 38, in this example.

FIGS. 11 through 15 show in greater detail the configuration of the C-clamp jaw 20. Note that in the preferred embodiment the C-clamp jaw 20 is fabricated from a single piece of material. An appropriate metal or plastic material can be used.

FIGS. 16 through 20 show further enlarged details of the cup holder 32 and hat hanger configuration 34, as described above. Particularly note that in this example, the cup holder 32, as clearly shown in the cross-sectional view of FIG. 20, includes a plurality of internal decreasing diameter sections 94, 96, 98, and 100, respectively, in this example, for retaining different size cups, respectively. Also note that in this example, the hat or cap holder 34 is configured to have large diameter at outermost portion 35 rigidly connected to a smaller diameter innermost portion 33 it is concentric therewith, the innermost portion 33 being rigidly connected to the topmost ring portion 94 of cup holder 32, in this example. Note that the cup holder 32 and the associated cap hanger 34 can be made from any appropriate metal or plastic material. If made from a plastic material, the cup holder 32 and cap holder 34 can be molded in a single piece.

Figure 21A:
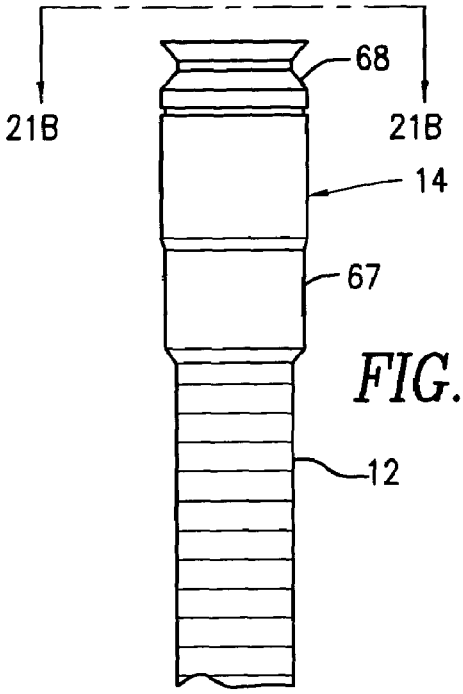
FIG. 21A is a front elevational view showing a swivel head attached to a flexible gooseneck for one embodiment of the invention.
Figure 21B:
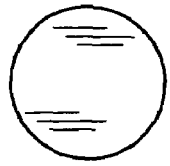
FIG. 21B shows a top plan view of the swivel head of FIG. 21A.

FIGS. 21A and 21B show enlarged details of the swivel head 14 as connected to an end of the super flexible gooseneck 12. The free end of the swivel head 14 includes a V-groove 68, as shown, whereas the lowermost portion of opposite end 67 has a collar-like configuration for a rigid attachment to the end of gooseneck 12, as shown. The top of the swivel head 14 is circular and flat, as shown in FIG. 21B.

Figure 22:
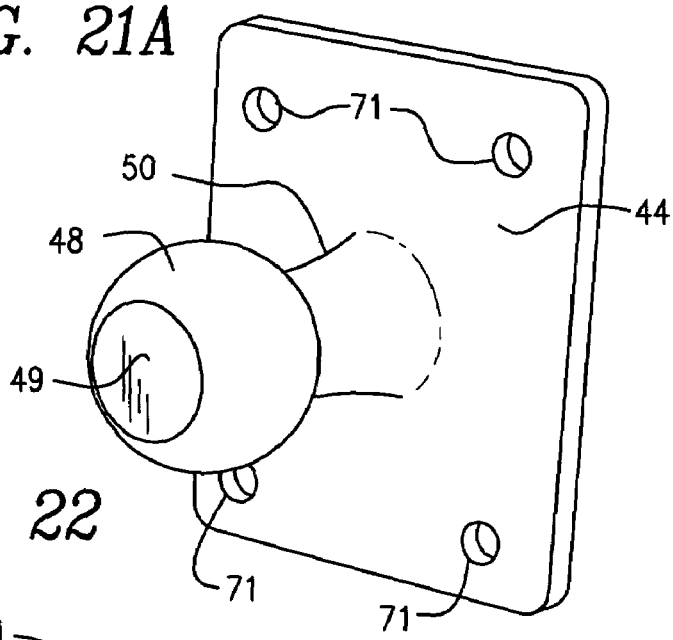
FIG. 22 shows a pictorial of a combined mounting plate, ball shaft, and ball head assembly formed from a unitary piece of material or separate components, for another embodiment of the invention.
Figure 23:
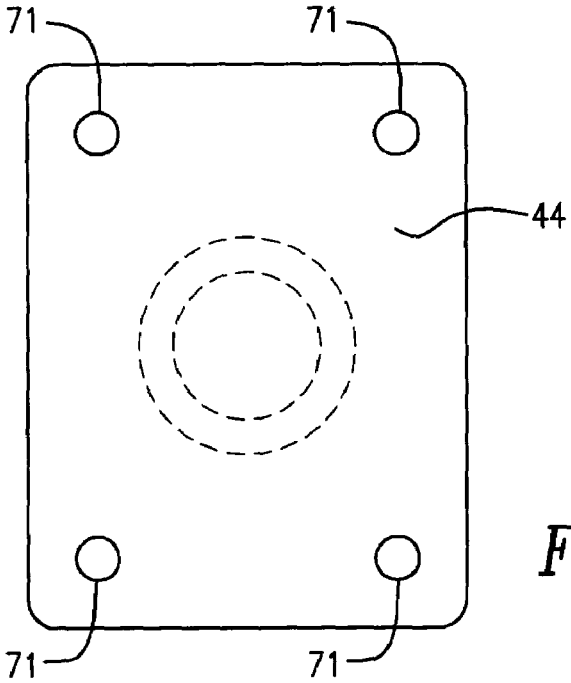
FIG. 23 shows a back elevational view of the assembly of FIG. 22.

In FIG. 22 an enlarged detail view is shown of the configuration of the ball head 48 as attached to an end of a shaft 50, the end of the latter being rigidly secured to the mounting plate 44. This assembly can be provided from a single piece of material, such as from a molded plastic, or from an appropriate metal material. Alternatively, ball head 48, ball shaft 50, and retention plate 44 can be provided as separate components rigidly connected together via other means. The back of the mounting plate 44 is shown in FIG. 23. Note that in an engineering prototype ball head 48 has a flat free end 49, as shown in FIG. 22, but can be completely rounded.

Figure 24:
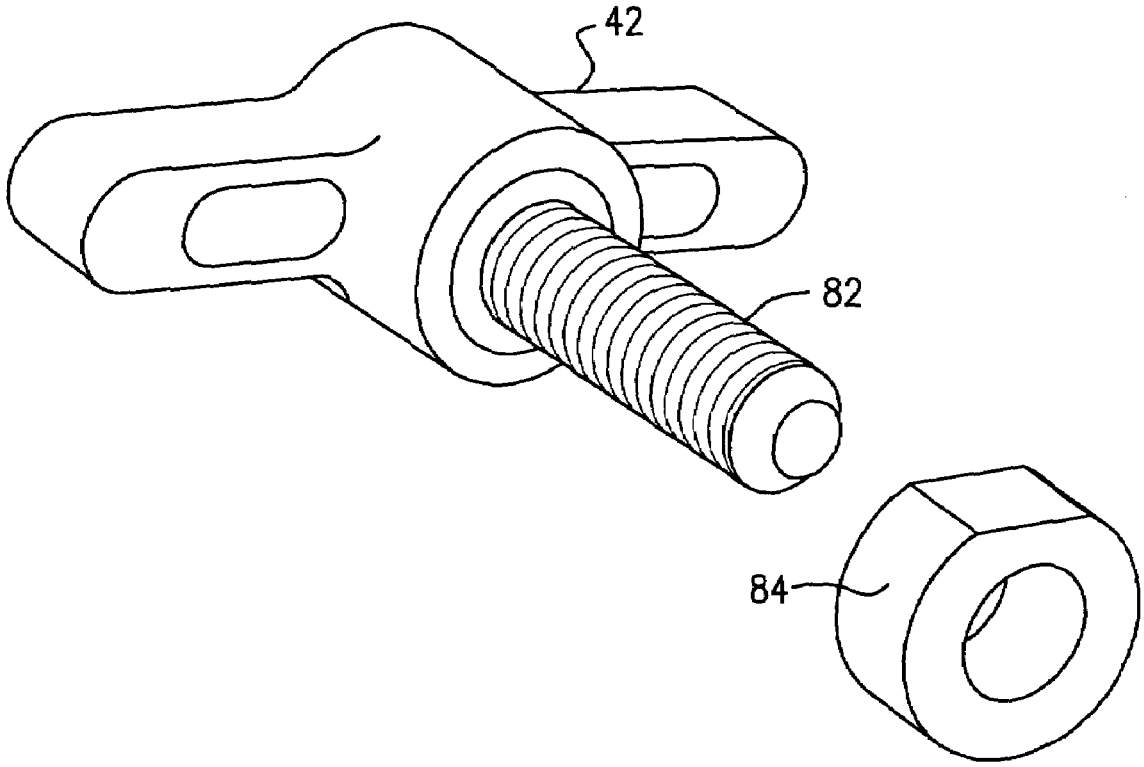
FIG. 24 shows an exploded assembly view of a swivel adjustment knob affixed to a threaded shaft and an associated spacer bushing.

An enlarged pictorial view of the adjustment knob 42 rigidly secured to a threaded shaft 82, all in association with a spacer bushing 84 is shown in FIG. 24. Note that the knob 42 is shown to have a butterfly configuration, in this example, in order to substantially reduce its interference with positional movement of the book holder tray 4.

Figure 25:
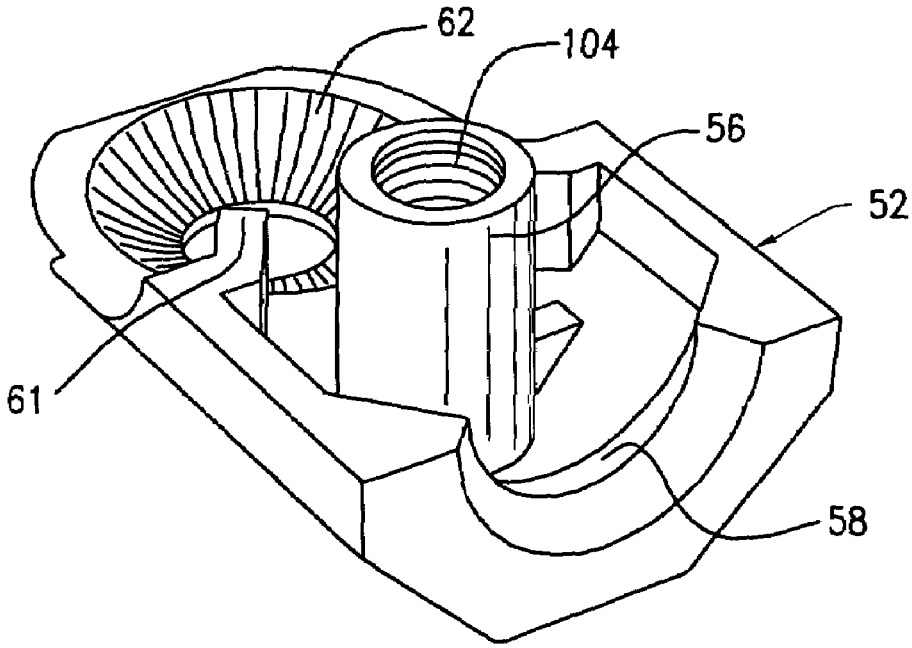
FIG. 25 shows a pictorial view of the interior configuration for a threaded housing half-section for a combined ball joint and swivel assembly for an embodiment of the invention.
Figure 26:
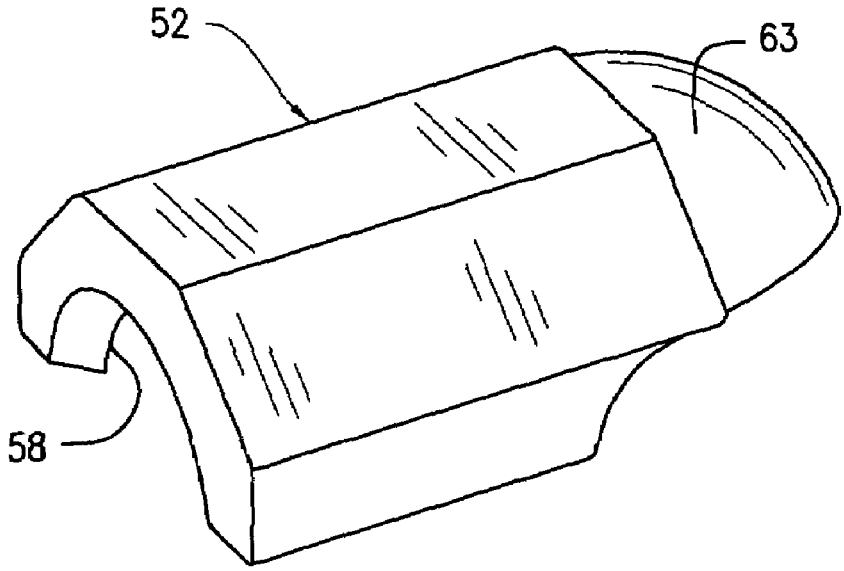
FIG. 26 is a pictorial view of the exterior sidewall portions of the housing section of FIG. 25.
Figure 27:
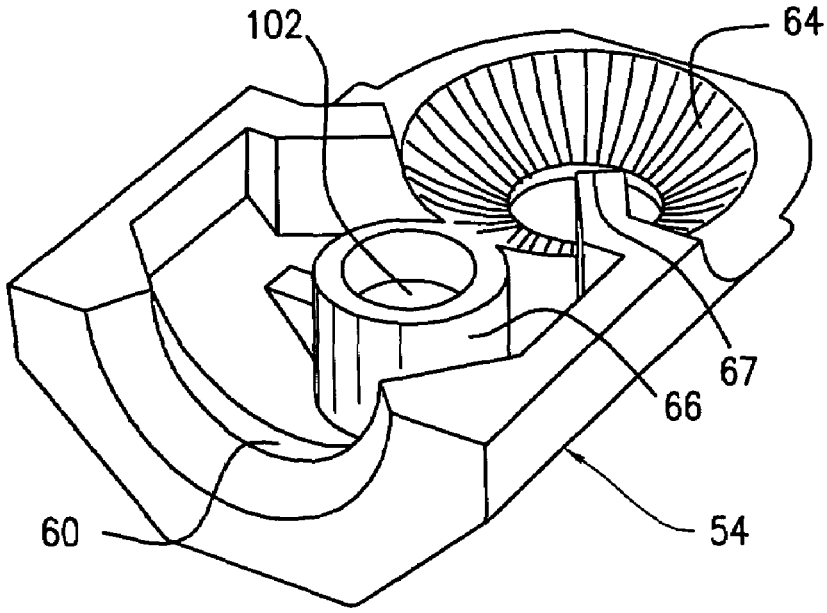
FIG. 27 is a pictorial view of the interior configuration for an unthreaded housing half-section for mating with the housing half-section of FIG. 25.
Figure 28:
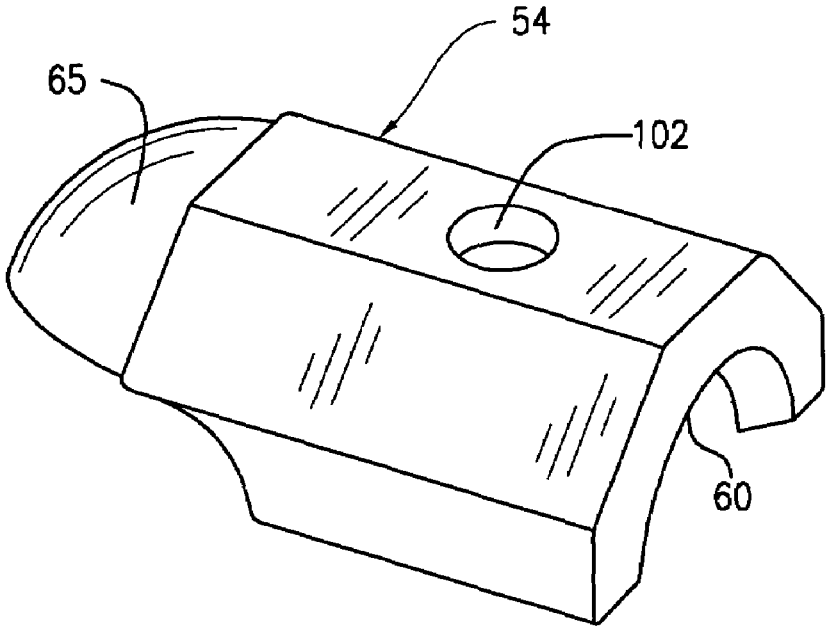
FIG. 28 shows a pictorial view of the exterior outside wall configuration of the housing-half section of FIG. 27.

Enlarged views of the threaded housing half sections 52, 54 are shown in FIGS. 25 and 26. In FIG. 25, an interior configuration of the threaded housing half section 52 is shown in great detail. FIG. 26 shows details of the exterior configuration 63 of the housing half section 52. Similarly, FIGS. 27 and 28 show enlarged detail reviews of the interior configuration of the unthreaded housing half section 54, and its exterior configuration 65. Note that the through hole 102 of unthreaded housing half section for receiving the threaded shaft 82 of adjustment knob 42, and the threaded bushing 56 includes a threaded hole 104 into which the threaded shaft 82 of knob 42 is screwed, for retaining the two housing half sections 52 and 54 together for captively retaining therein the ball head 38 and swivel head 14, as previously described.

The operation of the universal book holder 2 will now be described. With reference to FIGS. 1 through 5, showing the universal book holder 2 in its fully assembled state, the first step is to determine a location on an appropriate structural member of a piece of indoor/outdoor furniture, such as the arm of a chair or chaise lounge, for example, upon which a user wishes to sit or lie down on. The knob 30 of vise assembly 16 is turned in the direction for moving the circular jaw away from the top clamp face 22 of the C-clamp jaw 20 to permit the aforesaid to be positioned on the structural member or furniture arm, whereafter knob 30 is turned in a direction for tightly securing the structural member or arm between the clamp face 22 and the circular jaw 24. The positioning is selected to permit the gooseneck 12 to be bent in a direction for positioning the book holder tray 4 at least in the vicinity of where the user would like the book holder tray 4 to be located. Next, the adjustment knob 42 of the ball joint/swivel assembly 40 is loosened, for permitting the user to rotate the book holder tray 4 bringing the extended lip 10 of the tray 4 substantially parallel to the user's line of vision, while at the same time moving the tray upward and downward through an arc via the action of the ball head 48 being rotatable within the housing 46. When the book holder tray 4 is properly positioned, the knob 42 is turned to bring the housing half sections 52 and 54 closer together for locking the swivel head 14 and ball head 48 into position. The book is then placed onto the book holder tray 4. If the user is outdoors, and the sun is presenting objectionable glare, the anti-glare film 6 is placed over the page or pages of the book being read to substantially reduce the glare, and permit the user to more comfortably read. If glare is not a problem, the book can merely be placed over the anti-glare film 6. If the user or reader desires to either rest from reading, or to move out of the chair or other piece of indoor/outdoor furniture the reader is using, the reader simply bends the gooseneck 12 to a position where the book holder tray 4 is out of the way. When the user returns to continue reading, the gooseneck 12 is then bent in a direction for repositioning the book tray 4 as required. Obviously, there is no strict order for using the gooseneck 12 in combination with the ball joint/swivel assembly 40 to position the book holder tray 4, whereby all three of these adjustment means can be utilized in any desired sequence or repetitive manner for positioning the book holder tray 4 in essence in three dimensional space to obtain the desired position thereof. Note also that when the vise assembly 16 is installed on the structural member on the indoor/outdoor furniture to be used by the user or reader, the cup holder 32 is rotated to an upright position for holding a cup, if desired. Also, the user can hang their hat or cap on the cap holder 34. Note that through use of the three adjustment means, namely the gooseneck 12, combined ball joint/swivel assembly 40, the universal book holder 2 can be used for holding a book when the user or reader is either prone, as might occur when using a chaise lounge, for example, or in a sitting position when upon a chair, for example. The universal book holder 2 can be utilized for any type of furniture, including beach furniture, common household outdoor furniture, or indoor furniture, and can also be utilized in certain hospital beds, for example.

The various components of the present invention can be made from any appropriate material, such as a plastic or metal material. For example, if gooseneck 12 is made from a metallic material, in one embodiment of the invention it can be covered with a shrink wrap tubing in order to both protect the metallic material, and to avoid the possibility of a user's hair being caught in the tubing material. The invention is not meant to be limited to the use of a gooseneck 12, but any bendable material for positioning a mechanical member attached to one end can be utilized. In an engineering prototype, a super flexible gooseneck 12 is utilized that was capable of supporting up to a five pound book on the book holder tray 4. Also note, with reference to FIG. 6, anti-glare film 6 can be provided with holes through its top portion for alignment with the holes 76 of the retention strip 38, and holes 78 at the top of the backrest 8 of the book tray 4, whereby the screws 80 are inserted through the front of the backrest 8, through the holes in the anti-glare film 6, and screwed into the holes 76 of strip 38, for securely attaching the film 6, rather than merely clamping film 6 between retention strip 38 and backrest 8, as previously described.

In the engineering prototype, the anti-glare film 6 was provided by a tinted semitransparent vinyl material. However, any suitable material can be used.

Those of skill in the art may recognize other modifications to the present invention as described above, which modifications are meant to be covered by the spirit and scope of the appended claims. For example, in yet a further example, note that the ball joint/swivel assembly 40 can be used for other than a book holder application, for facilitating the positioning of an object in three dimensional space, that is for positioning an object in desired x, y, and z coordinates. In this latter example, the ball joint/swivel assembly 40 would be attached to the object, and otherwise supported by structural means, such as a stationary rod, for example.

What is claimed is:

1. A multi-positionable book holder comprising:

a tray for holding a book, said tray including a flat front face, flat back, right and left side edges, a top edge, and a bottommost lip extending outward from said front face upon which the bottom portion of a book can rest when the book is placed on the front face of said tray;

an elongated arm having first and second ends, said arm being adapted for selectively bending it to a desired orientation in any desired direction;

a positioning mechanism connected between the back of said tray and said first end of said arm, for both permitting said tray to be swiveled in the plane of its front face to any desired position between 0° and 360° from any starting position, and to be rotated about a longitudinal axis of said elongated arm to a desired position;

a vise clamp mechanism connected to said second end of said arm for attaching said book holder to an arm of indoor or outdoor furniture including beach chairs, chaise lounges, lawn chairs and beds;

a cup holder rotationally secured to an exterior face of a back portion of said vise clamp mechanism, via a fastener inserted through a hole in one end of an upper portion of said cup holder and in a hole in a back portion of said vise clamp; and a cylindrical cap hanger being rigidly connected to an outside wall of another end of the upper portion of said cup holder, said cap hanger having a diameter outermost portion rigidly and concentrically connected to a smaller diameter innermost portion rigidly connected to a topmost ring portion of said cup holder opposite said fastener.

2. The book holder of claim 1, further including:

an anti-glare film having a top portion secured to a top portion of the front face of said tray, for covering a page of a book being read.

3. The book holder of claim 2, wherein said anti-glare film consists of semitransparent vinyl material tinted to have anti-glare properties.

4. The book holder of claim 2, further including:

a narrow film retention strip removably attached to the top portion of the front face of said tray, the top portion of said film being sandwiched therebetween.

5. The book holder of claim 1, wherein said elongated arm includes a super-flexible gooseneck capable of retaining its position when a book is placed on said tray.

6. The book holder of claim 1, wherein said positioning mechanism includes:

a housing enclosing and providing at one end a portion of a ball joint mechanism, another portion of said ball joint mechanism being rigidly secured to the back of said tray, and said housing enclosing and providing at an opposite end a portion of a swivel mechanism, another portion of the latter being rigidly secured to the first end of said elongated arm; and an adjustment knob having a screw rod portion screwed into said housing, said housing being adapted for locking said ball joint and swivel mechanisms into position upon tightening of said adjustment knob, and for permitting operation of said ball joint and swivel mechanisms upon loosening of said adjustment knob.

7. The book holder of claim 6, wherein said housing includes:

a first half section having a hole in a side portion through which said screw rod passes;and a second half section having a threaded boss on an interior wall portion for receiving said screw rod.

8. The book holder of claim 6, wherein said swivel mechanism includes:

said housing having a first half section mated to a second half section that are moved toward one another via tightening of said adjustment knob, and away from one another via loosening of said adjustment knob;

the opposite ends of said half first and second half sections of said housing each including a semicircular interior V-shaped lip opposing the other;

a swivel head secured to the first end of said elongated arm, said swivel head including a circular V-shaped groove for retention between the V-shaped lips of said housing half sections, said housing being rotatable about said swivel head when said adjustment knob is loosened, and being locked in position on said swivel head when said adjustment knob is tightened.

9. The book holder of claim 6, wherein said ball joint mechanism includes:

said housing having a first half section mated to a second half section;

a mounting plate rigidly secured to the back of said tray;

a shaft having one end rigidly secured to said mounting plate, and another end protruding away from said mounting plate;

a ball head rigidly secured to said another end of said shaft;

said one end of said first and second half sections of said housing each including an interior semicircular shaped cavity opposing one another for retaining said ball head, and permitting movement thereof when said adjustment knob is loosened allowing said first and second half sections of said housing to move slightly away from one another, and preventing movement thereof when the half sections of said housing are moved toward one another via tightening of said adjustment knob.

10. The book holder of claim 9, wherein said swivel mechanism includes:

the opposite ends of said half first and second half sections of said housing each including a semicircular interior V-shaped lip opposing the other;

a swivel head secured to the first end of said elongated arm, said swivel head including a circular V-shaped groove for retention between the V-shaped lips of said housing half sections, said housing being rotatable about said swivel head when said adjustment knob is loosened, and being locked in position on said swivel head when said adjustment knob is tightened.

11. The book holder of claim 10, further including:

an anti-glare film having a top portion secured to a top portion of the front face of said tray, for covering a page of a book being read.

12. The book holder of claim 9, wherein the semicircular shaped cavities of each of said first and second half sections of said housing have a serrated surface.

13. The book holder of claim 9, wherein said adjustment knob has its screw rod portion passing through a hole in a sidewall of one of said first and second half sections of said housing, and screwing into a threaded boss on the interior of the other of said first and second half sections of said housing.

14. The book holder of claim 1, wherein said vise clamp mechanism includes:

a C-shaped main bracket including a top, a back, and a bottom spaced from and opposing said top portion, the exterior of said top portion being rigidly connected to said second end of said arm, and a threaded hole through a protruding free end of the bottom;

a threaded bolt member screwed into said hole in the bottom of said bracket, a first end of said bolt opposing the top of said bracket, and a second end protruding away from the bottom of said bracket;

a knob rigidly attached to the second end of said bolt member;

a jaw attached to the first end of said bolt member, whereby said knob is rotated in one direction for moving said jaw toward the top of said bracket, and in an opposite direction for moving said jaw away from the top of said bracket, for securing or removing said clamp mechanism from an arm of indoor or outdoor furniture.

15. The book holder of claim 14, whereby side portions of the top of said C-shaped main bracket are angled for clamping to both round and flat arms of said furniture.

16. The book holder of claim 1, wherein said cup holder includes:

an open top section having a diameter for receiving a cup of relatively large diameter; and a plurality of successively smaller diameter sections proceeding from said top section, for receiving cups of relatively smaller diameter than said large diameter cup, respectively.

17. A combined book, cup, and cap holder comprising:

a tray for holding a book, said tray including a flat front face, flat back, right and left side edges, a top edge, and a bottommost lip extending outward from said front face upon which the bottom portion of a book can rest when the book is placed on the front face of said tray;

an elongated arm adapted for being selectively bent to a desired orientation in any desired direction, said arm having first and second ends;

a ball joint and swivel assembly connected between the back of said tray and said first end of said arm, for both permitting said tray to be rotated or swiveled in the plane of its front face over 360°, and to be rotated about a longitudinal axis of said arm, for selectively positioning said tray;

a C-clamp having a top portion rigidly connected to the second end of said arm, a back portion, a bottom portion, and a jaw member attached to said bottom portion and adapted for moving between said bottom and top portions for securing therebetween to an arm of indoor or outdoor furniture, an inside face of said top portion being angled to facilitate securement to both round and flat arms;

a cup holder rotationally secured to an exterior face of said back portion of said C-clamp, via a fastener inserted through a hole in one end of an upper portion of said cup holder and in a hole in a back portion of said vise clamp; and a cylindrical cap hanger being rigidly connected to an outside wall of another end of the upper portion of said cup holder, said cap hanger having a diameter outermost portion rigidly and concentrically connected to a smaller diameter innermost portion rigidly connected to a topmost ring portion of said cup holder opposite said fastener, said cap hanger secured to an exterior surface of said cup holder; and an anti-glare film having a top portion secured to a top portion of the front face of said tray, for covering a page of a book being read to reduce glare.

* * * * *